US012004603B1

(12) United States Patent
Hsiao

(10) Patent No.: US 12,004,603 B1
(45) Date of Patent: Jun. 11, 2024

(54) ILLUMINATED SEAT BELT BUCKLE

(71) Applicant: HON YU AUTO PARTS CO., LTD., New Taipei (TW)

(72) Inventor: Yin-Teng Hsiao, New Taipei (TW)

( * ) Notice: Subject to any disclaimer, the term of this patent is extended or adjusted under 35 U.S.C. 154(b) by 0 days.

(21) Appl. No.: 18/369,191

(22) Filed: Sep. 17, 2023

(30) Foreign Application Priority Data

Apr. 11, 2023 (TW) ..... 112113469

(51) Int. Cl.
*A44B 11/00* (2006.01)
*A44B 11/25* (2006.01)

(52) U.S. Cl.
CPC ..... *A44B 11/005* (2013.01); *A44B 11/2565* (2013.01)

(58) Field of Classification Search
CPC . A44B 11/005; A44B 11/2565; F21V 7/0091; B60R 22/12
USPC ..... 362/511
See application file for complete search history.

(56) References Cited

U.S. PATENT DOCUMENTS 4,933,818 A * 6/1990 Eckmann ..... G02B 6/0001 362/559
5,176,439 A * 1/1993 Kawamura ..... A44B 11/2565 362/108
5,892,436 A 4/1999 Blackburn et al.
10,080,401 B2 9/2018 Effenberger
10,722,002 B2 * 7/2020 Harms ..... A44B 11/2565
11,229,261 B2 * 1/2022 Soehnchen ..... A44B 11/2523
2012/0188778 A1 * 7/2012 Buettner ..... A44B 11/2565 362/487
2014/0268844 A1 * 9/2014 Knoedl ..... A44B 11/2565 362/488
2017/0001557 A1 * 1/2017 Fujii ..... B60R 22/12
2017/0127765 A1 * 5/2017 Betz ..... F21V 23/009

FOREIGN PATENT DOCUMENTS

CN 205273406 U 6/2016
DE 3904125 A1 8/1989

* cited by examiner

*Primary Examiner* — Laura K Tso
(74) *Attorney, Agent, or Firm* — Bruce Stone LLP; Joseph A. Bruce

(57) ABSTRACT

The present invention provides an illuminated seat belt buckle, includes a buckle body, an unlock button configured on an upper open end of the buckle body, an illuminating portion, and a light-emitting module. The illuminating portion, configured at an upper portion of the unlock button, consists of a light-guide body and an outer covering layer, and a light incident area located on the side of the illuminating portion and a first illuminating area located above the illuminating portion are formed at a portion of the light-guide body exposing from the outer covering layer. The light-emitting module is configured on the buckle body, which includes a light guider and a light-emitting element, in which the light guider has a light-guiding port. The light-guiding port is used to guide the lights generated from the light-emitting element into the light incident area of the illuminating portion to make the first illuminating area emits light. Under above constructions, the unlock button combines with the illuminating portion to form as a light-emitting button so as to make the light-emitting button to have guiding and warning functions and/or decorative luminous effects.

9 Claims, 5 Drawing Sheets

ILLUMINATED SEAT BELT BUCKLE

BACKGROUND

Technical Field

The present invention relates to an illuminated seat belt buckle applicable to various vehicles equipped with seat belt devices. Particularly, to an illuminated seat belt buckle which is able to provide guiding and warning functions and/or decorative light effects through an unlocking button on the seat belt buckle.

Description of Related Art

The design with a luminous function of a seat belt buckle, it is not only able to indicate the location of seat belt buckle for the driver or passenger, but also guide the driver or passengers to fasten the seat belt tongue quickly and accurately into the seat belt buckle.

In the various known published prior art, Chinese Utility Model Patent CN 205273406 U, U.S. Pat. Nos. 5,892,436, and 10,080,401 individually disclose variety of seat belt buckle designs that can provide light-emitting functions, by using a light source within the seat belt buckle to provide guiding, warning or decorative illumination effects.

The patent No. CN 205273406 U discloses a casing shell, that can be fitted on the outside of a conventional seat belt buckle, and a light-emitting element and a light-transparent cover are combined on the casing shell to provide a light-emitting effect.

In addition, U.S. Pat. Nos. 5,892,436 and 10,080,401 respectively disclose different solutions in which a circular light-transparent part or a light-guiding part is arranged at the opening end of the upper edge of a housing of the belt buckle seat. With the light source installed inside the housing, the light-transparent part or the light-guiding part provides a luminous effect.

From the above description, it discloses the seat belt buckle with a luminous effect can indeed achieve the function of guiding the position of the seat belt buckle. However, as far as the currently known design solutions are concerned, the housing of the seat belt buckle is combined with a light-transparent member or a light-guiding member to achieve the luminous effect.

SUMMARY

In view of above, the present invention provides an illuminated seat belt buckle. The main purpose of the present invention is to provide an illuminated seat belt buckle that is distinguishing from conventional, and provides guiding and warning functions and/or decorative luminous effects.

In order to achieve the above-mentioned purpose, the present invention provides an illuminated seat belt buckle, comprising: a buckle body; an unlock button configured on an upper open end of the buckle body, wherein an illuminating portion, configured at an upper portion of the unlock button, consists of a light-guide body and an outer covering layer, and the light-guide body exposing the outer covering layer, forming a light incident area on the side of the illuminating portion and a first illuminating area above the illuminating portion; and a light-emitting module, configured on the buckle body, comprising a light guider and a light-emitting element, wherein the light guider has a light-guiding port to guide the lights generated from the light-emitting element into the light incident area of the illuminating portion to make the first illuminating area emit light.

Through the above constructions, the unlock button combines with the illuminating portion to form as a light-emitting button, provides guiding and warning functions and/or decorative luminous effects.

In some embodiments, it shows that the illuminating portion attached to a cover on the upper part of the unlock button, such as attaching the illuminating portion on the upper part of the unlock button by adhesive or other various methods. In addition, the illuminating portion can also be implemented in a way that is integrally formed on the upper part of the unlock button. In other words, the illuminating portion can be an additional component combined on the upper part of the unlock button or a part molded directly on the upper part of the unlock button.

In some embodiments, the outer covering layer in the illuminating portion can be made of either opaque or translucent materials. When the outer covering layer is made of opaque material, only the light-guide body that exposed from the outer covering layer transmit light. If the outer covering layer is made of a translucent material, the outer covering layer will transmit light at the same time.

In some embodiments, in addition to having the first illuminating area on the illuminating portion, the illuminating portion also able to have a second illuminating area located on the side of the illuminating portion. Wherein, the first illuminating area is presented in the form of text or images, providing a luminous effect with guiding and warning functions. The second illuminating area is used for projecting a light source towards the interior of the buckle body to provide a decorative luminous effect.

In some embodiments, the illuminating portion further includes a light-guide plate configured in the light-guide body, and the light source obtain a more uniform luminous effect through the light-guide plate.

In some embodiments, the light-emitting module can adopt an embodiment that is combined on the outside of the buckle body, or it is also able to be combined inside the buckle body.

In some embodiments, the light-emitting module is electrically connected to a power supply through a signal power cable, the power supply also has a signal control function to provide the power and control signals required by the light-emitting module.

The detailed features and advantages of the present invention will be described in detail in the following embodiments, and the content is sufficient to enable anyone familiar with the relevant art to understand the technical content of the present invention and implement it accordingly, and according to the content disclosed in this specification and the scope of patent application With the drawings, anyone who is familiar with the relevant art can easily understand the purpose and advantages of the present invention.

DESCRIPTION OF THE EMBODIMENTS

It should be noted that when an element is referred to as being "fixed to" another element, it can be directly on the other element or a central element may also exist. When an element is considered to be "connected" to another element, it can be directly connected to the other element or an intermediate element may also exist. The terms "vertical", "horizontal", "left", "right" and similar expressions used herein are for illustrative purposes only, and do not mean it is the only implementation.

Unless otherwise defined, all technical and scientific terms used herein have the same meaning as commonly understood by those skilled in the technical field of the present invention. The terms used in the specification of the present invention herein are only for the purpose of describing specific embodiments and are not intended to limit the present invention. The term "and/or" as used herein includes any and all combinations of one or more related listed items.

Figure 1:
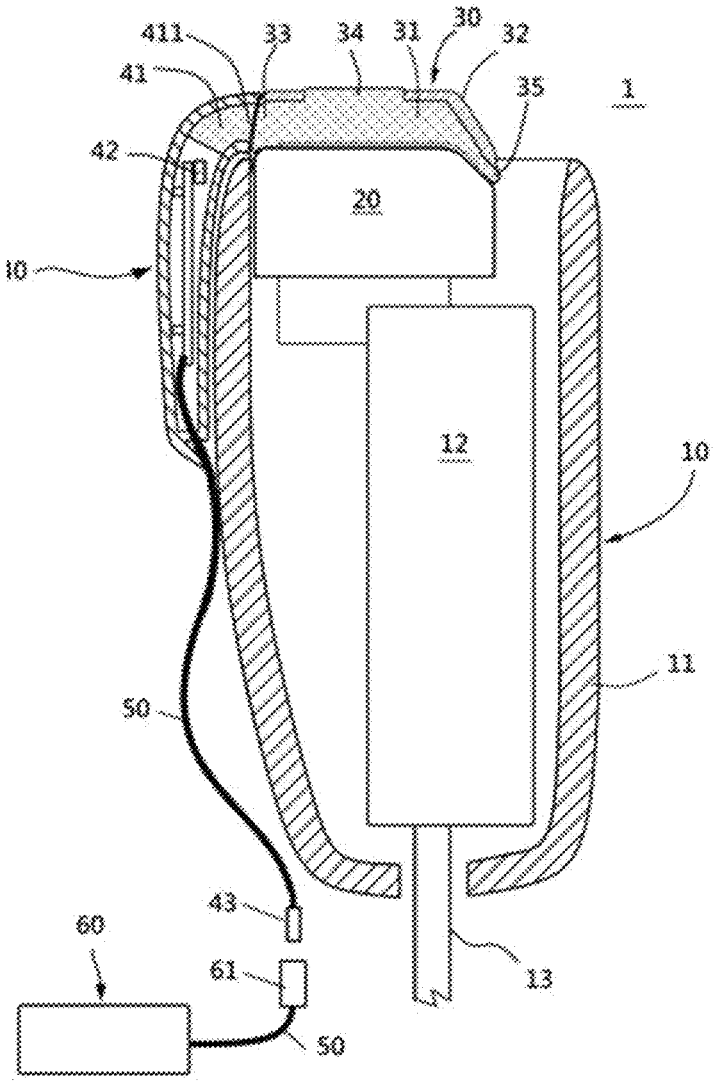
FIG. 1 is a schematic cross-sectional view of a preferred embodiment of the illuminated seat belt buckle of the present invention.
Figure 2:
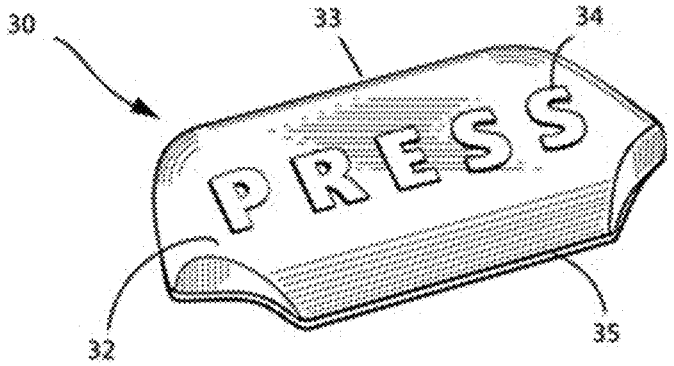
FIG. 2 is a three-dimensional schematic diagram of the illuminating portion in FIG. 1.
Figure 3:
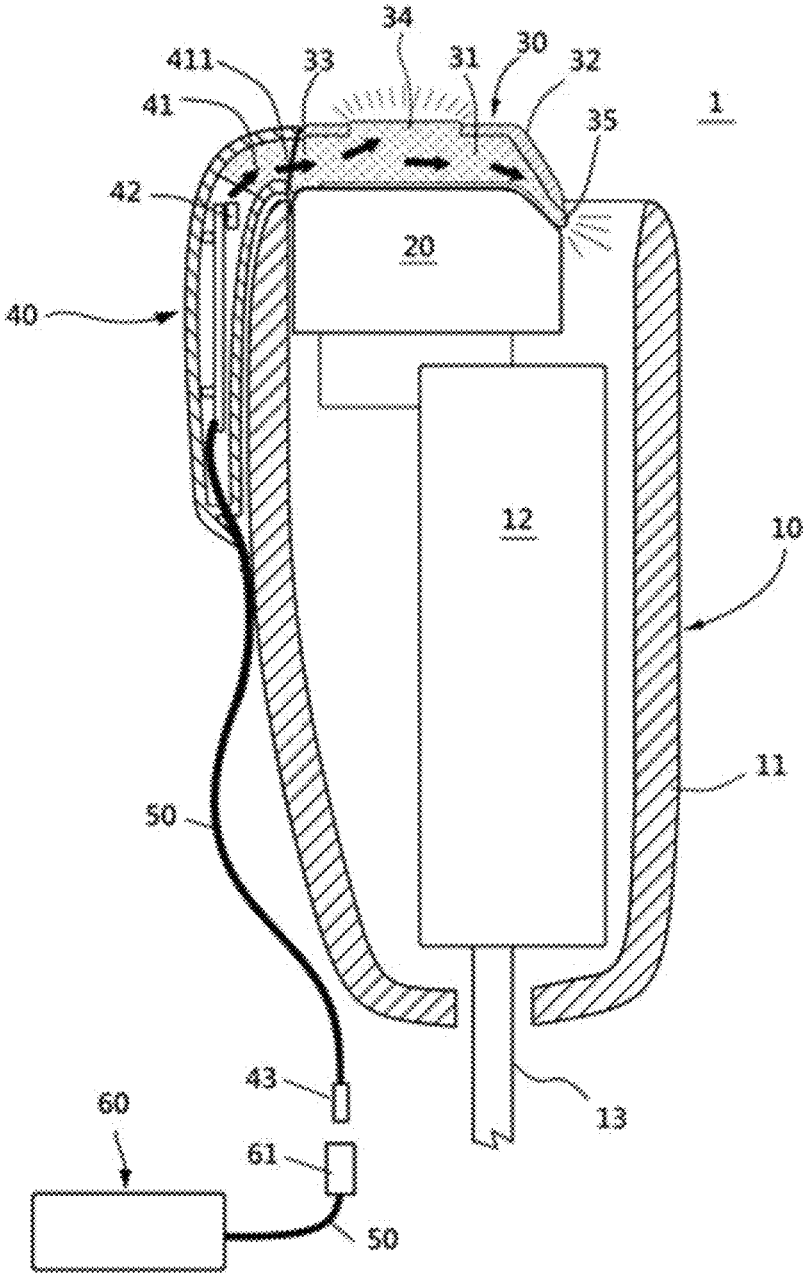
FIG. 3 is a schematic diagram of the use in FIG. 1.

Please refer to FIG. 1 to FIG. 3, FIG. 1 is a schematic cross-sectional view of a preferred embodiment of an illuminated seat belt buckle of the present invention, FIG. 2 is a three-dimensional schematic view of the illuminating portion in this embodiment, and FIG. 3 shows a schematic diagram of the use of this embodiment. As shown in the figures, the present invention provides is an illuminated seat belt buckle 1 applicable to various vehicles equipped with seat belt devices. The illuminated seat belt buckle 1 mainly includes a buckle body 10, an unlock button 20 configured at the upper opening end of the buckle body 10, an illuminating portion 30 configured on the upper part of the unlock button 20, and a light-emitting module 40 configured on the buckle body 10.

The buckle body 10 has a fixed seat 11, and the fixed seat 11 is provided with a locking device 12 connected to the vehicle and has an upper open end. The locking device 12 is connected to the vehicle by a bracket 13. The unlock button 20 is configured at the upper opening end of the buckle body 10. By pressing down the unlock button 20, the unlock button 20 is able to allow the locking device 12 to unlock it so as to release a seat belt tongue fastened in the buckle body 10.

The illuminating portion 30 is configured on the upper part of the unlock button 20, the illuminating portion 30 consists of a light-guide body 31 and an outer covering layer 32. The illuminating portion 30 is formed by integral molding two different materials. The materials are defined as materials with good light guiding effect (such as PC material) to applied as the light-guide body 31, and opaque materials (such as surface plated acrylic) to applied as the outer covering layer 32. A light incident area 33 located on the side of the illuminating portion 30 and a first illuminating area 34 located above the illuminating portion 30 are formed at a portion of the light-guide body 31 exposing from the outer covering layer 32. Wherein, the first illuminating area 34 is presented in the form of text (the text "PRESS" as shown in FIG. 2) or an image.

In another embodiment, in addition to having the first illuminating area 34 located above the illuminating portion 30, the light-guide body 31 is also able to have a second illuminating area 35. The second illuminating area 35 is located on the side of the illuminating portion 30 and is formed at another portion exposing from the outer covering layer 32. The second illuminating area 35 is used to project a light source towards the inside of the buckle body 10, as shown in FIG. 3.

Specifically, the light-guide body 31 in the illuminating portion 30 is made of a material with light guide effect. In addition, the outer covering layer 32 in the illuminating portion 30 can be made of either opaque or translucent material. In this way, when the outer covering layer 32 is made of opaque material, the area of the light-guide body 31 covered by the outer covering layer 32 transmits light, only the first illuminating area 34 and the second illuminating area 35 of the light-guide body 31 exposed from the outer covering layer 32 transmit light. If the outer covering layer 32 is made of a translucent material, the outer covering layer 32 and the light-guide body 31 will both transmit light. Therefore, different luminous effects are presented.

The light-emitting module 40 is configured on the buckle body 10, which includes a light guider 41 and a light-emitting element 42, in which the light guider has a light-guiding port 411. The light-guiding port 411 is used to guide the lights emitted from the light-emitting element 42 into the light incident area 33 of the illuminating portion 30 to make the first illuminating area to emit a light by passing through the first illuminating area 34 and the second illuminating area 35. With this configuration, the unlock button 20 combines with the illuminating portion 30 to form as a light-emitting button to provide guiding and warning functions and/or decorative luminous effects.

Figure 4:
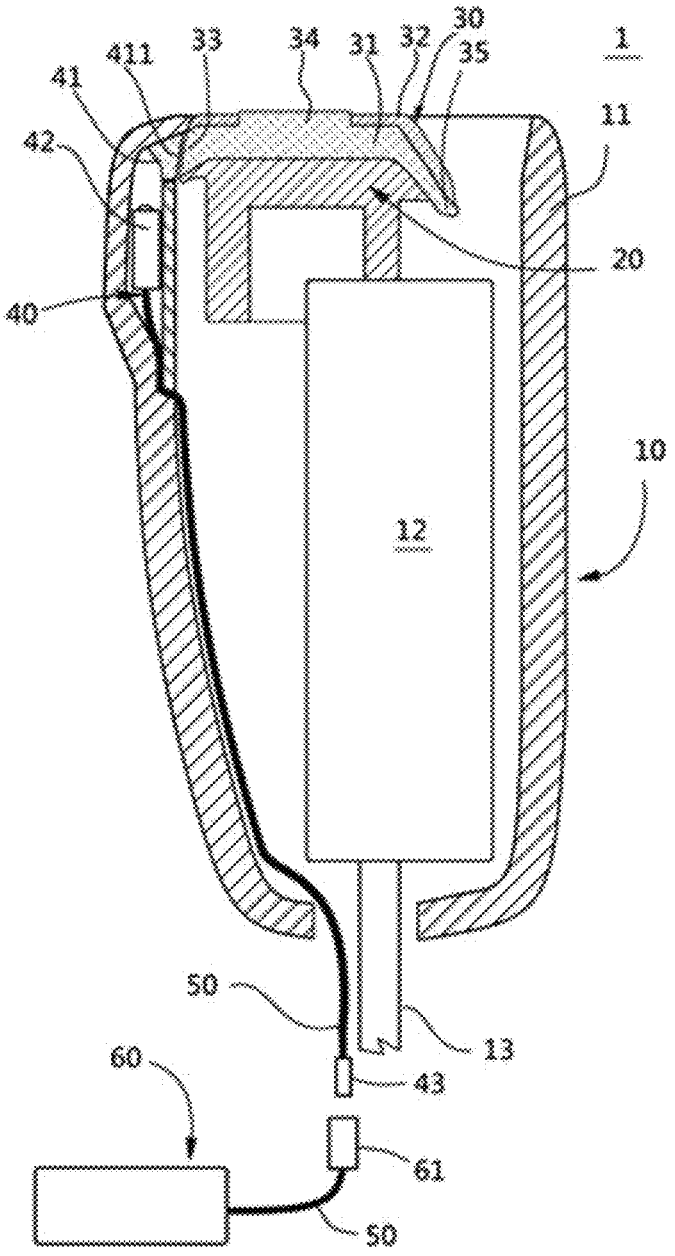
FIG. 4 is a schematic cross-sectional view of another preferred embodiment of the illuminated seat belt buckle of the present invention.

In another embodiment, apart from configuring the light-emitting module 40 at the outer portion of the buckle body 10, the light-emitting module 40 is able to be configured inside the buckle body 10 (as shown in FIG. 4). The light-emitting module 40 is electrically connected to a power supply 60 through a signal power cable 50, the power supply 60 also has a signal control function to provide the power and control signals required by the light-emitting module 40. As shown in the figure, the light-emitting module 40 and the power supply 60 are respectively provided with a signal power cable connector 43 and 61 that can be connected to each other.

As shown in FIG. 2, in this embodiment, the illuminating portion 30 is attached to a cover on the upper part of the unlock button 20 by adhesive or other various methods. In other words, the illuminating portion 30 is detachable on the upper part of the unlock button 20, and can be replaced or exchanged at any time.

Figure 5:
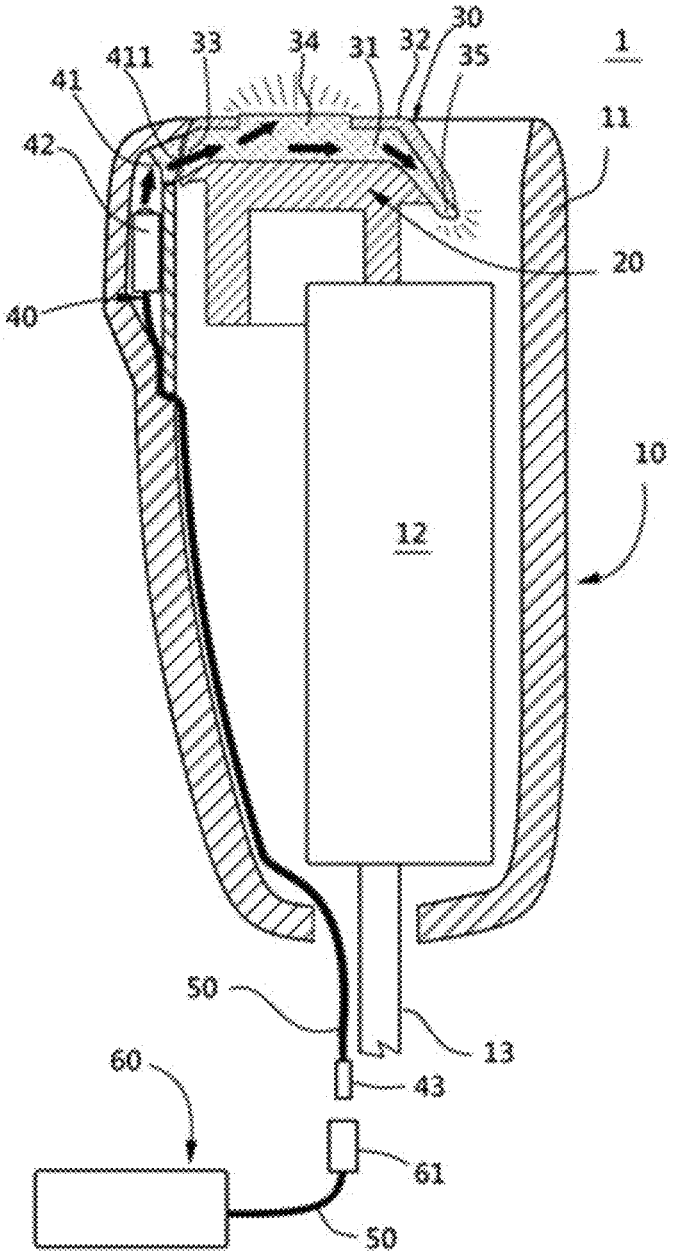
FIG. 5 is a schematic diagram of the use in FIG. 4.

FIG. 4 and FIG. 5 are the cross-sectional schematic diagrams and schematic diagrams showing another preferred embodiment of the illuminated seat belt buckle 1 of the present invention. The illuminated seat belt buckle 1 includes the buckle body 10, the unlock button 20 configured at the upper opening end of the buckle body 10, the illuminating portion 30 configured on the upper part of the unlock button 20, and the light-emitting module 40 configured on the buckle body 10.

Compared with the previous embodiment disclosed in FIGS. 1 to 3, this embodiment mainly has the following two differences:

(1) The illuminating portion 30 is integrally formed on the upper part of the unlock button 20, that is to say, the illuminating portion 30 is directly molded and combined with the unlock button 20, and is a part of the unlock button 20.

(2) The light-emitting module 40 is arranged and combined inside the buckle body 10, the signal power cable 50 used to electrically connect the light-emitting module 40 and the power supply 60 that passes through a hole at the bottom of the buckle body 10.

It is disclosed that, during implementation, the illuminating portion 30 is an additional component that can be additionally attached to the upper part of the unlock button 20 by adhesive or other various methods, it can also be implemented in a way that is integrally formed on the upper part of the unlock button 20. In addition, the light-emitting module 40 can adopt an embodiment that is combined on the outside of the buckle body 10, or it is also able to be combined inside the buckle body 10.

Figure 6:
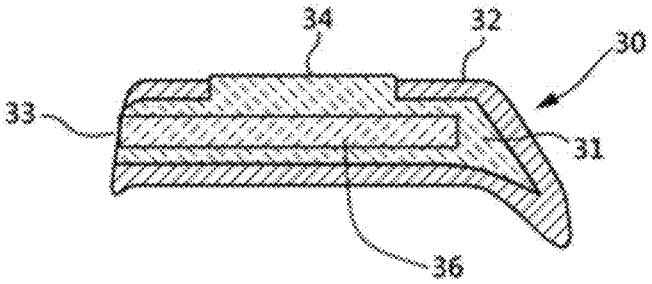
FIG. 6 is a schematic cross-sectional view of another embodiment of the illuminating portion.

Please refer to the schematic cross-sectional view of another embodiment of the illuminating portion shown in FIG. 6, the illuminating portion 30 is configured on the upper part of the unlock button 20, the illuminating portion 30 consists of the light-guide body 31 and the outer covering layer 32. The light incident area 33 and the first illuminating area 34 are formed at a portion of the light-guide body 31 exposing from the outer covering layer 32. In addition, the illuminating portion 30 further includes a light-guide plate 36 configured in the light-guide body 31, and the light source injected through the light incident area 33 can obtain a more uniform luminous effect through the light-guide plate 36.

In summary, it can be known that the present invention is an illuminated seat belt buckle 1 that can be applied on various vehicles equipped with seat belt devices. Different from the known prior art, the present invention provides an illuminating portion 30 comprised of light-guide body 31 and the outer covering layer 32 on the upper end of the unlock button 20, It can have guiding and warning functions and/or decorative luminous effects by means of the unlock button 20 provided with the illuminating portion 30 on the upper end.

The above are the preferred embodiments of this application, and the scope of protection of this application is not limited accordingly. Therefore: all equivalent changes made in accordance with the structure, shape, and principle of this application shall be covered by the scope of protection of this application inside.

What is claimed is:

1. An illuminated seat belt buckle, comprising:

a buckle body;

an unlock button located on the buckle body;

an illuminating portion having a bottom located on the unlock button, a top opposite the bottom, and a side between the top and the bottom, and includes a light-guide body, an outer covering layer, a light incident area located on the side of the illuminating portion, a first illuminating area located on the top of the illuminating portion, and a light-guide plate located in the light-guide body; and a light-emitting module located on the buckle body, and comprising a light guider and a light-emitting element, wherein the light guider has a light-guiding port configured to guide lights generated from the light-emitting element into the light incident area of the illuminating portion to the first illuminating area.

2. The illuminated seat belt buckle of claim 1, wherein the illuminating portion is formed by integral molding.

3. The illuminated seat belt buckle of claim 1, wherein the outer covering layer is made from an opaque material or a translucent material.

4. The illuminated seat belt buckle of claim 1, wherein the first illuminating area is in the form of texts or an image.

5. The illuminated seat belt buckle of claim 1, further comprising a second illuminating area located on the side of the illuminating portion.

6. The illuminated seat belt buckle of claim 1, wherein the light-emitting module is outside of the buckle body.

7. The illuminated seat belt buckle of claim 1, wherein the light-emitting module is inside of the buckle body.

8. The illuminated seat belt buckle of claim 1, wherein the light-emitting module is electrically connected to a power supply.

9. The illuminated seat belt buckle of claim 8, wherein;

the light-emitting module and the power supply are respectively provided with a first signal power cable and a second signal power cable;

the light-emitting module is further provided with a first connector connected to the first signal power cable; and the power supply is further provided with a second connector connected to the second signal power cable.

* * * * *